United States Patent [19]

Spector et al.

[11] Patent Number: 4,595,564

[45] Date of Patent: Jun. 17, 1986

[54] CARTRIDGE-TYPE AROMA PERCOLATOR

[76] Inventors: Donald Spector, 380 Mountain Rd., Union City, N.J. 07087; Robert H. Miller, 11 Woodbine Trail, Parsippany, N.J. 07054

[21] Appl. No.: 626,726

[22] Filed: Jul. 2, 1984

Related U.S. Application Data

[63] Continuation-in-part of Ser. No. 357,630, Mar. 12, 1982.

[51] Int. Cl.[4] ..... A62B 7/08

[52] U.S. Cl. ..... 422/125; 422/4; 422/275; 422/305; 422/306

[58] Field of Search ..... 422/125, 124, 4, 305, 422/306, 5, 218, 275, 311; 239/53

[56] References Cited

U.S. PATENT DOCUMENTS

| | | | |
|---|---|---|---|
| 1,484,072 | 2/1924 | Moore | 422/125 |
| 1,589,072 | 6/1926 | Hamacheck | 422/306 |
| 1,706,639 | 10/1927 | Shaack et al. | 560/89 |
| 2,207,889 | 7/1940 | Kingman | 422/125 |
| 2,485,356 | 11/1949 | Brown et al. | 415/146 |
| 2,531,084 | 3/1953 | Sommer | 239/53 |
| 2,618,892 | 4/1950 | Locks et al. | 239/53 |
| 2,942,090 | 6/1960 | Diehl | 422/306 |
| 3,006,042 | 5/1960 | Calandra | 422/306 |
| 3,080,624 | 3/1963 | Weber, III | 422/125 |
| 3,948,445 | 4/1976 | Andeweg | 422/125 |
| 4,200,229 | 4/1980 | Spector | 224/42.46 R |
| 4,339,079 | 7/1982 | Sato et al. | 422/306 |
| 4,346,059 | 8/1982 | Spector | 422/4 |

*Primary Examiner*—Barry S. Richman
*Assistant Examiner*—Titus B. Ledbetter, Jr.
*Attorney, Agent, or Firm*—Michael Ebert

[57] ABSTRACT

A cartridge-type aroma percolator for wafting fragrance into the atmosphere at a relatively high rate. The percolator includes a cylindrical container having a vented cap and a base provided with a raised hub housing an electric heater. Telescopically inserted into the container is a replaceable cartridge having a can whose base has a reentrant socket that complements and receives the hub. Placed adjacent the upper end of the can is a liquid-permeable toroidal insert incorporating a pad of porous material, the insert defining therebelow a chamber having a pool therein of an aqueous solution of a volatile liquid fragrance. A tube coaxial with the can extends through the hollow core of the barrier, the tube inlet being immersed in the pool adjacent the socket, the tube outlet being above the barrier. When the heater is energized, the solution in the region of the socket is caused to boil to produce a head of pressurized gas above the pool, forcing the liquid to rise in the tube and to be discharged from the outlet to shower onto the insert whereby the liquid percolates through the pad before returning to the chamber. An aromatic vapor emitted from the pad is wafted into the atmosphere through the vented cap of the percolator. A removable cover means is provided for hermetically sealing said can, and for storing the contents thereof, while the cartridge is not in use.

5 Claims, 4 Drawing Figures

Fig. 1.
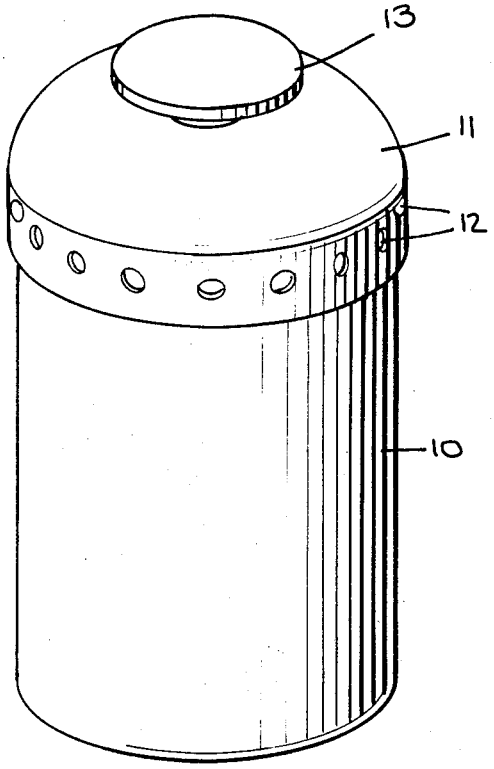
Fig. 2.
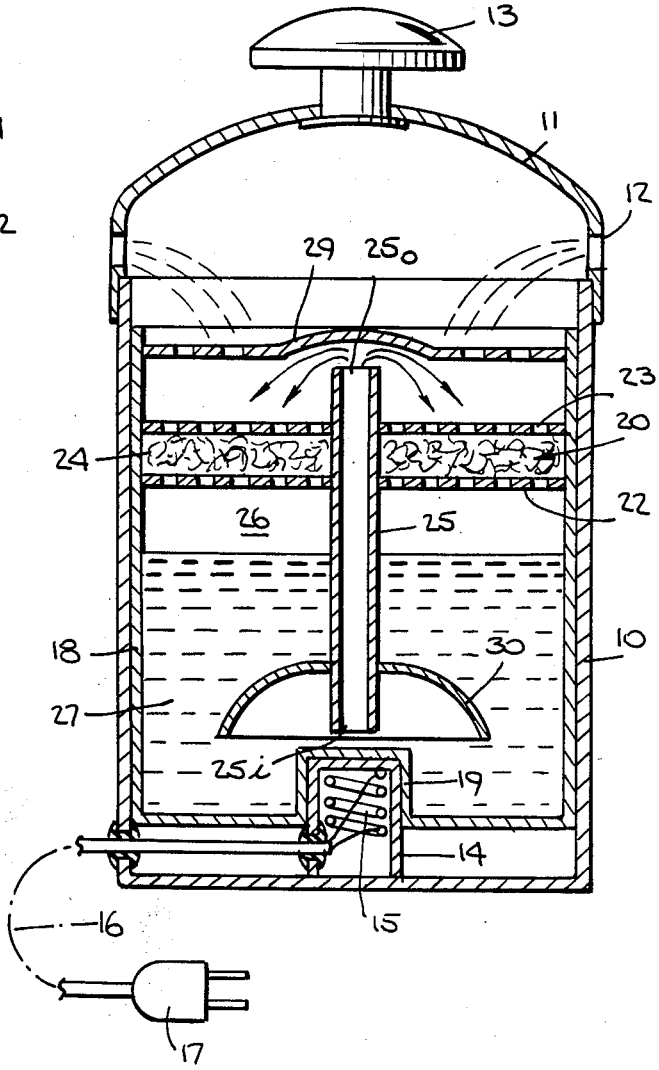
Fig. 3.
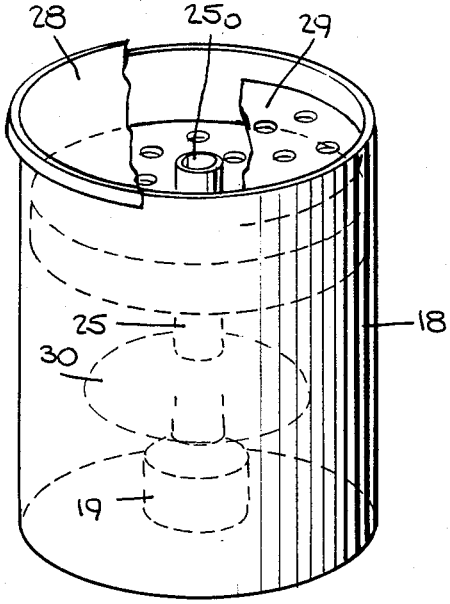
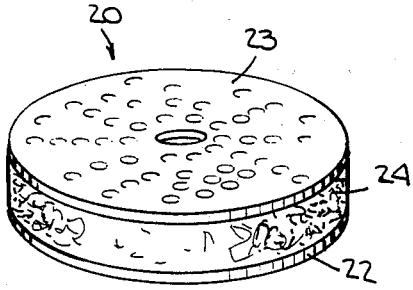
Fig. 4.

CARTRIDGE-TYPE AROMA PERCOLATOR

BACKGROUND OF INVENTION

This invention relates generally to aroma generators, and more particularly to an electrically-powered aroma percolator that includes a replaceable cartridge containing an aqueous solution of a volatile liquid fragrance.

As used herein, the term "aroma" is not limited to pleasant or savory smells, but encompasses scents that function as insecticides, air fresheners, deodorants, or ant other odor that acts to condition, or otherwise charge the atmosphere to modify the environment.

The aroma of perfumes and perfume-based products such as colognes and toilet waters was originally derived from the essential oils of plants. However, since the early 19th century, chemists have succeeded in analyzing many essential oils and in creating thousands of synthetics, some simulating natural products and others yielding altogether new scents. Perfumes today are largely blends of natural and synthetic scents and of fixatives which equalize vaporization and enhance pungency. In most liquid scents the ingredients are dissolved in alcohol.

Vaporization of an aroma-producing liquid which impregnates a porous carrier may be effected by the heat produced by an electric lamp or other heater elements. Thus the Evans U.S. Pat. No. 2,372,371 discloses a pad saturated with a liquid deodorant held in a small container mounted directly on a light bulb, the resultant heat penetrating the pad to volatilize the deodorant. Similar bulb-type heater arrangements are shown in the Gudeman, U.S. Pat. Nos. 1,403,548; Schlesinger, 2,485,356; Diehl, 2,942,090 and Rosenthal, 1,706,639 patents.

Instead of impregnating a pad or other relatively large porous elements with an aromatic liquid, in the Locks et al. patent U.S. Pat. No. 2,618,892, the liquid is impregnated in small pieces of sponge material held within a flexible bulb. To extract the aroma, the bulb must be squeezed, no heat being used in this instance.

Aroma generators of the type heretofore known are incapable of exuding a fragrance at a high rate such as to quickly permeate a large area. Thus if an aroma generator of the Evans type were to be placed in a meeting hall or small auditorium, its fragrance would be fairly strong in the immediate vicinity of the generator but scarcely detectable elsewhere. Hence generators of this known type would have little effect in modifying the environment of a hall or other enclosure having a large atmospheric volume.

The need often arises for environmental odor control, as in a large meeting hall where the atmosphere may be rendered unpleasant because of crowded conditions, smoking and other odor-producing factors. Where the hall or chamber is air-conditioned, it is possible to introduce a deodorizer or fragrance into the stream of air flowing out of the conditioner. But this requires that the conditioner include this capability and that one has ready access thereto.

In the typical middle class home or apartment, it is not an uncommon practice on special occasions to burn incense or use other aroma generating means to modify the environment in a manner appropriate to prevailing conditions. But expedients for this purpose have very limited coverage; and if one wishes to transform the environment in a matter of minutes, this cannot be accomplished by existing aroma generators suitable for household use.

In my copending application, there is disclosed an aroma generator capable of wafting a fragrance into the atmosphere at a relatively high rate whereby the atmosphere of a large room or other enclosure may be quickly modified and rendered more agreeable. Use is made for this purpose of a percolator whose water container has a removable domed cap provided with vents.

The container is mounted on a base having an electrical heating element therein which when energized acts to boil the water in a well formed in the bottom of the container. Extending upwardly from the well is a tube which extends to a point below the dome of the cap. The tube passes through a basket having a perforated lid and bottom, the basket being filled with a charge of porous pellets impregnated with a volatile liquid fragrance. The basket is supported on the tube at a position in the container above the level of the water bath therein.

In operation, the boiling water rises in the tube to be ejected therefrom against the dome, the boiling water being deflected thereby to shower the perforated basket and percolate through the pellets therein before returning to the bath. The liquid fragrance in the pellets volatilizes to produce an aromatic vapor which is emitted into the atmosphere through the vents.

One practical difficulty with the percolator disclosed in the co-pending application is that the user, each time the unit is put to a fresh use, must fill the container with water and he must remove the basket to dispose of the exhausted pellets and place a fresh charge of pellets therein before putting the basket back in the container.

This procedure is not troublesome when the aroma generator is used in a home having a water supply and an adequate stock of impregnated pellets having different aromas for use with the generator. But in some situations, as when the generator is to be used in an auditorium or show room, one may have to take along a water supply and a substantial stock of pellets, and this may be inconvenient.

Moreover, the water in the container has liquid fragrance from the pellets added thereto when the generator operates, and when switching over to a new fragrance, one has to first carefully wash out the container to remove all traces of the old fragrance so that it does not contaminate the new fragrance; and this, too, is a complicating factor.

SUMMARY OF INVENTION

In view of the foregoing, the main object of this invention is to provide an aroma percolator in which all operating elements thereof, including the liquid fragrance, save for the container and electrical heater, are housed in a replaceable cartridge which is telescopically inserted in the container.

An aroma percolator in accordance with the invention has distinct practical advantages over an aroma percolator of the type disclosed in the copending application; for all the user has to do is to insert the cartridge in the container and turn on the switch, there being no need to place pellets in a basket, to fill the container with water, or to assemble the tube and basket within the container.

More particularly, an object of this invention is to provide disposable cartridges for an aroma percolator having different fragrances, so that to switch from one fragrance to another, one simply changes the cartridge.

A significant advantage of the cartridge-type aroma percolator is that the liquid fragrance is held within the cartridge and does not contaminate the container; hence there is no need to wash out the container before switching to a new fragrance. Another advantage is that the cartridge takes the form of a sealed can that can be stored indefinitely, and activated simply by means of a standard can opener.

Also an object of this invention is to provide cartridges for an aroma percolator that may be mass-produced at low cost in a large variety of fragrances.

Briefly stated, these objects are attained in a cartridge-type aroma percolator for wafting fragrance into the atmosphere at a relatively high rate. The percolator includes a cylindrical container having a vented cap and a base provided with a raised hub housing an electric heater. Telescopically inserted into the container is a replaceable cartridge having a can whose base has a reentrant socket that complements and receives the hub. Placed adjacent the upper end of the can is a liquid-permeable toroidal insert incorporating a pad of porous material, the barrier defining therebelow a chamber having a pool therein of an aqueous solution of a volatile liquid fragrance. A tube coaxial with the can extends through the hollow core of the barrier, the tube inlet being immersed in the pool adjacent the socket, the tube outlet being above the insert. When the heater is energized, the solution in the region of the socket is caused to boil to produce a head of pressurized gas above the pool, forcing the liquid to rise in the tube and to be discharged from the outlet to shower onto the insert whereby the liquid percolates through the pad before returning to the chamber. An aromatic vapor emitted from the pad is wafted into the atmosphere through the vented cap of the percolator.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a cartridge-type aroma percolator unit in accordance with the invention;

FIG. 2 is a longitudinal section taken through the central plane of the unit;

FIG. 3 is a perspective view of the cartridge; and

FIG. 4 is a perspective view of the insert.

DESCRIPTION OF INVENTION

Referring now to the figures, there is shown a cartridge-type aroma percolator in accordance with the invention, the percolator including a cylindrical container 10 of stainless steel or other suitable material. The container is provided with a removable cap 11 having a circumferential array of side vents 12 and a dome-shaped roof to which a handle 13 is attached. In practice, cap 11 may be provided with an adjustable shutter, as in the copending application, to vary the effective size of the vent openings.

The base of container 10 is provided at its center with a raised round hub 14 within which is housed an electric heater element 15. This element is connected by a cable 16 to a male plug 17 for insertion in an AC power socket. In practice, a thermostat switch may be included to maintain the heat generated at a substantially constant level.

Telescopically inserted in container 10 is a replaceable cartridge that includes a cylindrical can 18 provided at its base with a reentrant socket 19 that complements and receives hub 14 when the cartridge is properly seated within the container.

Secured within can 18 at a fixed position adjacent the top thereof is a toroidal insert, generally designated by numeral 20, having a hollow core 21. Barrier 20 is constituted by upper and lower annular discs 22 and 23 between which is sandwiched an annular pad 24 of porous material made of blotting paper, non-woven fabric, open-cell foam plastic or other material having good liquid absorbent properties. The discs are perforated, so that the insert is liquid permeable.

Supported by the insert and extending therethrough is a tube 25 whose upper end lies above the insert to provide an outlet $25_o$. The lower end of the tube which is adjacent socket 19 provides an inlet 25. Supported in can 18 above outlet $25_o$ is a disc 29 having a center dome surrounded by a flat apertured region. Secured to the lower pad of tube 25 is a metal umbrella 30.

Insert 20 defines within can 18 a chamber 26 which is partly filled with an aqueous bath 27 of a volatile liquid fragrance in a concentration that depends on how strong an aroma is desired. The cartridge can containing the liquid is normally hermetically sealed by means of cover 28 of the type used commercially on ground coffee cans. This cover is removable by means of a standard can opener which cuts the cover along its peripheral seal line.

Thus cartridges having different fragrances can be stored in sealed cans provided with identifying labels, so that the user simply chooses a can having the fragrance he desires.

In operation, when the electric heater is energized, heat radiating from hub 14 is transferred to socket 19 to heat the liquid in the umbrella region to the boiling point, resulting in a rise in gas pressure in the head above the pool in chamber 26 which forces the boiling liquid up tube 25. This liquid is discharged from outlet $25_o$ of tube 25 against the dome of disc 29 and caused thereby to shower down on barrier 20. The liquid percolates through pad 24 before returning to bath 27 for recirculation. The hot liquid-impregnated pad 24 emits an aromatic vapor which is discharged into the atmosphere through vents 12 of the cap, thereby modifying the atmosphere of the enclosure in which the percolator is installed.

The aroma-producing fragrance which impregnates the pad has an alcohol carrier whose boiling point is lower than that of water. Hence while the heat absorbed by the pad from the boiling of water percolating therethrough acts to reduce the water temperature to a degree limiting steaming thereof, this heat acts to volatilize the fragrance component to produce an aromatic vapor which is discharged from the unit through the vents in the cap. This aromatic emission into the atmosphere takes place at a high rate omnidirectionally around the cap so that the environment is quickly modified.

Since the boiling water continues to circulate from the pool to the disc dome and from there through the insert back into the pool, the pad is continuously subjected to heat to generate an aromatic vapor at a rapid volumetric rate. And because relatively little water is evaporated as steam, the aqueous pool is adequate for prolonged operation without replenishment. When, however, the aromatic liquid is exhausted, it becomes a simple matter to remove and discard the spent cartridge and place in a fresh cartridge with a fresh supply of liquid fragrance into the container.

While there has been shown and described a preferred embodiment of a cartridge-type aroma percolator in accordance with the invention, it will be appreciated that many changes and modifications may be made therein without, however, departing from the essential spirit thereof. Thus, instead of a raised hub on the base of the container, a depressed socket may be provided therein surrounded by a heater coil, in which case the can of the cartridge would have a complementary projecting hollow plug that nests in this socket to form a liquid well, the tube inlet going into this well.

We claim:

1. A cartridge-type aroma percolator comprising:

(A) a container having an inside bottom surface, an electrical heater secured to the inside bottom surface and a removable vented cap; and (B) a replaceable cartridge telescopically received in said container, said cartridge being constituted by a can having a toroidal insert permeable to liquid secured at a position adjacent the top of the can and arranged so that it extends across an entire cross section of the can, the can and insert definining a chamber in the can below the toroidal insert that is partially filled with a pool of an aqueous solution of liquid fragrance, said insert having a hollow core and incorporating a porous pad surrounding the core, and a tube coaxial with the can extending through the hollow core of the insert, the lower end of the tube forming a liquid inlet immersed in the pool, whereby when the heater in the container is energized, the liquid in the can in a region above the heater is boiled to produce a gas pressure in a head space located above the pool in the chamber, forcing the liquid up the tube discharging it from the outlet thereof and showering it down on the insert thus percolating it through the pad before returning it to the pool, an aromatic vapor being exuded from the pad and discharged into the atmosphere through the vented cap, and whereby when the liquid is exhausted, one may dispose of the spent cartridge and replace it with a fresh cartridge; and (C) removable cover means for hermetically sealing said can, and for storing the contents thereof, while the cartridge is not in use.

2. A percolator as set forth in claim 1, wherein said heater is disposed in a hub secured to the inside bottom surface of the container, and said can has a reentrant socket which complements and receives said hub.

3. A percolator as set forth in claim 1, wherein said cap has a circumferential array of vents along its side.

4. A percolator as set forth in claim 1, wherein said insert is provided with upper and lower perforated discs between which the pad is sandwiched.

5. A percolator as set forth in claim 4, wherein said pad is formed of blotting paper.

* * * * *